US012421689B2

(12) United States Patent
Goldstein et al.

(10) Patent No.: US 12,421,689 B2
(45) Date of Patent: Sep. 23, 2025

(54) NON-CONDUCTIVE HYDRO-EXCAVATION WANDS INCORPORATING WEAR SLEEVES

(71) Applicant: MGE Underground, Inc., Paso Robles, CA (US)

(72) Inventors: Michaeljoe Goldstein, Paso Robles, CA (US); Jeremy Burns, Paso Robles, CA (US)

(73) Assignee: MGE Underground, Inc., Paso Robles, CA (US)

( * ) Notice: Subject to any disclaimer, the term of this patent is extended or adjusted under 35 U.S.C. 154(b) by 0 days.

(21) Appl. No.: 18/614,477

(22) Filed: Mar. 22, 2024

(65) Prior Publication Data

US 2024/0318404 A1 Sep. 26, 2024

Related U.S. Application Data

(60) Provisional application No. 63/491,866, filed on Mar. 23, 2023.

(51) Int. Cl.
*E02F 3/92* (2006.01)

(52) U.S. Cl.
CPC ..... *E02F 3/9262* (2013.01)

(58) Field of Classification Search
CPC ..... E02F 3/9262; E02F 3/9206
See application file for complete search history.

(56) References Cited

U.S. PATENT DOCUMENTS

| | | | | |
|---|---|---|---|---|
| 5,409,032 | A * | 4/1995 | Berfield | F04B 49/24 137/115.03 |
| 5,860,232 | A * | 1/1999 | Nathenson | E02F 5/003 175/215 |
| 7,389,949 | B2 * | 6/2008 | Marchand | B05B 12/0026 251/102 |
| 7,540,339 | B2 * | 6/2009 | Kolle | E21B 17/20 138/125 |
| 2021/0033239 | A1 * | 2/2021 | Auclair | E02F 7/10 |
| 2024/0200409 | A1 * | 6/2024 | Anderson | E02F 3/8891 |

* cited by examiner

*Primary Examiner* — Aaron L Lembo
(74) *Attorney, Agent, or Firm* — KPPB LLP

(57) ABSTRACT

Non-conductive hydro-excavation wands incorporating wear sleeves are disclosed. In one embodiment, a non-conductive hydro-excavation wand includes a non-conductive pipe, a non-conductive hose within the non-conductive pipe, a hand-actuated on/off valve connected to the non-conductive hose, a rigid, non-conductive tip at one end of the non-conductive pipe, the tip having an opening that is open to the interior of the non-conductive hose; and a wear sleeve of non-conductive material surrounding at least part of the non-conductive pipe.

17 Claims, 4 Drawing Sheets

NON-CONDUCTIVE HYDRO-EXCAVATION WANDS INCORPORATING WEAR SLEEVES

CROSS-REFERENCE TO RELATED APPLICATIONS

The current application claims the benefit of and priority under 35 U.S.C. § 119(e) to U.S. Provisional Patent Application No. 63/491,866 entitled "Non-Conductive Hydro-Excavation Wands Incorporating Wear Sleeves" filed Mar. 23, 2023. The disclosure of U.S. Provisional Patent Application No. 63/491,866 is hereby incorporated by reference in its entirety for all purposes.

FIELD OF THE INVENTION

The present invention generally relates to hydro-excavation, and more particularly to a rigid and non-conductive hydro-excavation pressure wand.

BACKGROUND

Hydro-excavation refers to the process of applying high-pressure water in order to break apart or liquefy soil. The treated soil is then vacuumed away. This process is preferable in many situations as it provides a controlled rate of excavation, impacts the environment less negatively compared to traditional methods, and allows for utility lines to remain in place with a lower chance of damage.

DETAILED DESCRIPTION

Turning now to the drawings, non-conductive hydro-excavation wands incorporating wear sleeves in accordance with various embodiments of the invention are illustrated. Many current hydro-excavation systems employ the use of pressure wands to deliver water and air to the soil. Additionally, many hydro-excavation projects involve excavating locations that contain utility lines within the ground such as, but not limited to, gas, coaxial, fiber-optics, and electrical cabling. Due to the pressure of the water and/or air that can be delivered by a hydro-excavation wand in accordance with an embodiment of the invention, the wand is subjected to significant forces when utilized within a confined space. Accordingly, non-conductive hydro-excavation wands in accordance with a number of the embodiments of intention incorporate a wear sleeve to protect a non-conductive pipe that connects the handle of the wand to a non-conductive tip. In several embodiments, the weight of the wand can be reduced by using a wear sleeve having a varying cross-section. In this way, additional protection for the non-conductive pipe can be provided close to the non-conductive tip. In several embodiments, the wear sleeve is constructed from multiple sections. In certain embodiments, the wear sleeve is constructed as a single piece.

Non-conductive hydro-excavation wands that incorporate wear sleeves in accordance with many of the embodiments of this invention utilize non-conductive elements. In several embodiments, non-conductive hosing is attached to the wand, and inserted within a pressure pipe for rigidity. Voids between the non-conductive hosing and the pressure pipe can be filled by epoxy and/or other non-conductive void filler material. In this way, a non-conductive hydro-excavation wand can be utilized to provide safer working conditions in environments that may contain high-voltage electrical lines. In several embodiments, a wear sleeve is utilized that is constructed from acetyl plastic. As can readily be appreciated, any of a variety of non-conductive materials can be utilized to construct a wear sleeve utilized to protect a non-conductive pipe in a non-conductive hydro-excavation wand as appropriate to the requirements of specific applications in accordance with various embodiments of the invention.

For non-conductive materials, the resistance to prevent electrical flow must be sufficient to prevent a harmful current were the wand to encounter a typical electrical current utilized in power distribution grids. More specifically, a non-conductive material should prevent the transmission of a fatal current of greater than 0.1 Amperes. Additionally, non-conductive materials should also have a sufficient dielectric rating suitable to prevent the transmission of high voltage currents such as 69-138 kV which may be encountered in underground utility lines.

Figure 1:
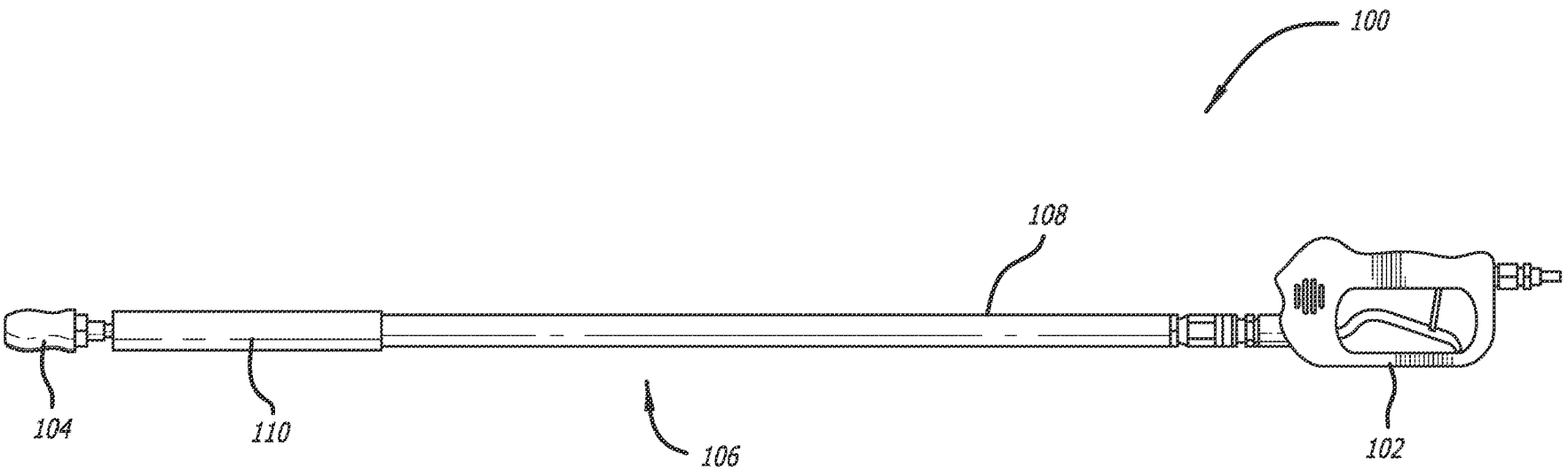
FIG. 1 is an illustration of a non-conductive hydro-excavation wand incorporating a wear sleeve in accordance with an embodiment of the invention.

A non-conductive hydro-excavation wand in accordance with an embodiment of the invention is illustrated in FIG. 1. The non-conductive hydro-excavation wand 100 contains a hand actuated on/off valve 102 that may be connected via a coupling to an external non-conductive high pressure hose. The non-conductive hydro-excavation wand 100 also contains a rigid, non-conductive tip 104 that delivers high-pressure water and/or air to the soil for excavation. A non-conductive pipe contains a non-conductive high pressure hose encased within the non-conductive pipe which may be composed of, but is not limited to, fiberglass, ceramic, Kevlar, and/or other rigid, non-conductive composites and/or plastics. The non-conductive pipe is itself encased in a wear sleeve 106. In the illustrated embodiment, the wear sleeve is an acetyl plastic wear sleeve constructed using two segments that are joined using screws. The first segment 108 surrounds the portion of the non-conductive pipe that connects to the hand actuated on/off valve 102. The second segment 110 surrounds the portion of the non-conductive pipe that connects to the non-conductive tip 104. The first segment is relatively thinner (i.e. has a smaller outer diameter) than the second segment. In this way, the second segment provides increased protection to the portion of the non-conductive pipe that is likely to experience the greatest abrasion and/or other forces during use. Between the non-conductive pipe and the non-conductive high pressure hose encased within is a filler material which may include, but is not limited to, epoxy, fiberglass, or any other non-conductive void-filler. The diameter and length of the hose and pipe may vary in size to allow changes in flow rate depending on the specific application. Furthermore, the wear sleeve can be formed as a single piece and/or does not need to extend along the entire length of the non-conductive pipe.

While a variety of non-conductive hydro-excavation wands are described above with reference to FIG. 1, the specific components utilized within a non-conductive hydro-excavation wand and the manner in which materials are chosen are largely dependent upon the requirements of specific applications. For example, Isolator RT76N 4000 PSI non-conductive hosing by RYCO Hydraulics Pty. Ltd. of Melbourne, Australia may be utilized for the non-conductive high-pressure hose in certain applications. In other embodiments, the size of the hose may be between ¼ and ¾ of an inch in diameter while the non-conductive pipe may be ½ to 1½ inches in diameter. In further embodiments, the non-conductive pipe may be composed of Dynaform RD Tube ISOFR 1 OD with a ⅛ inch wall by Figergrate Composite Structures of Dallas, Texas. The wear sleeve can be constructed to have a wall thickness of ¼ inch in a section of the wear sleeve adjacent the non-conductive tip. Handles that can be utilized in non-conductive hydro-excavation wands in accordance with various embodiments of the invention are discussed further below.

Figure 2:
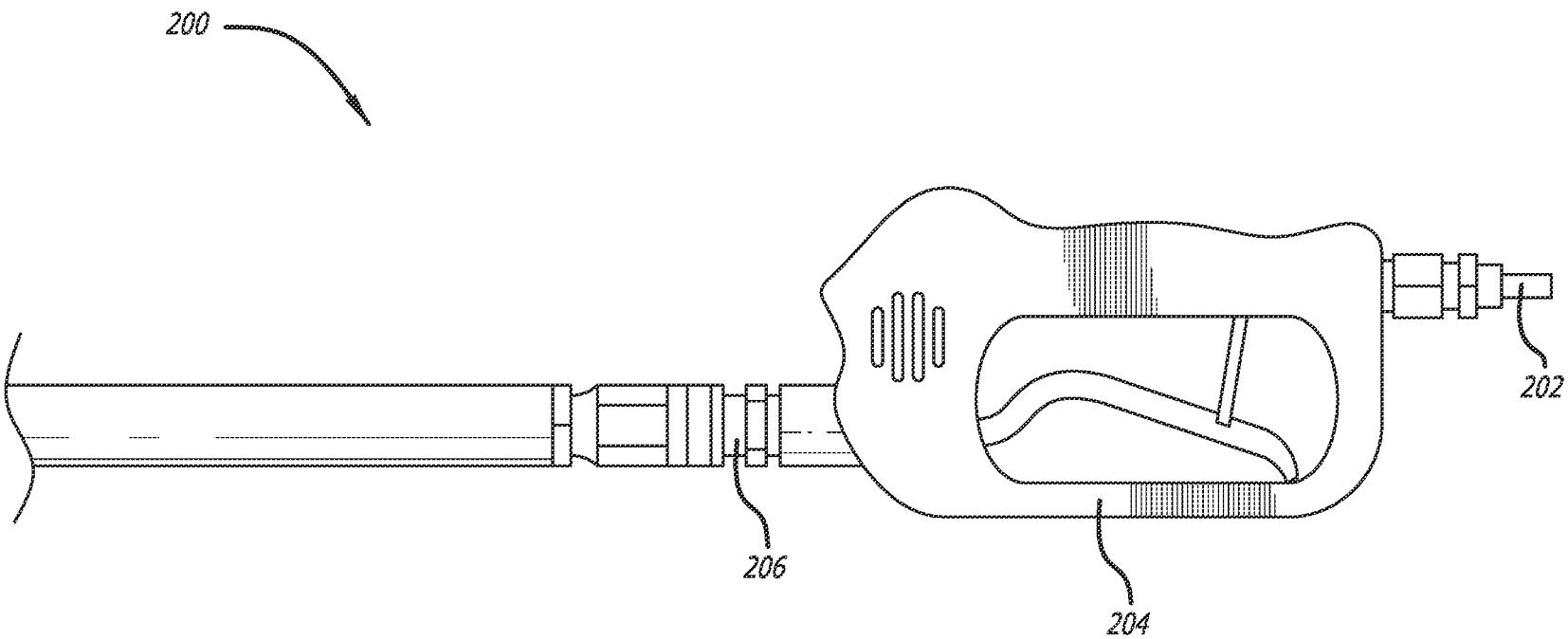
FIG. 2 is an illustration of a handle of a non-conductive hydro-excavation wand incorporating a wear sleeve in accordance with an embodiment of the invention.

A non-conductive hydro-excavation wand handle in accordance with an embodiment of the invention is illustrated in FIG. 2. The non-conductive hydro-excavation wand handle 200 contains a hand actuated on/off valve 204 that may be connected via a coupling to an external non-conductive high pressure hose via a high-pressure release valve 202. The non-conductive hydro-excavation wand handle 200 also contains a high-pressure coupler 206 that couples the hand-actuated on/off valve 204 with the non-conductive pressure pipe. The size and shape of the handle 204 may vary in size to depending on the specific application and method of use.

While a variety of non-conductive hydro-excavation wand handles are described above with reference to FIG. 2, the specific components utilized within a non-conductive hydro-excavation wand handle and the shapes chosen are largely dependent upon the requirements of specific applications. Delivery nozzles that can be utilized in non-conductive hydro-excavation wands in accordance with various embodiments of the invention are discussed further below.

Figure 3:
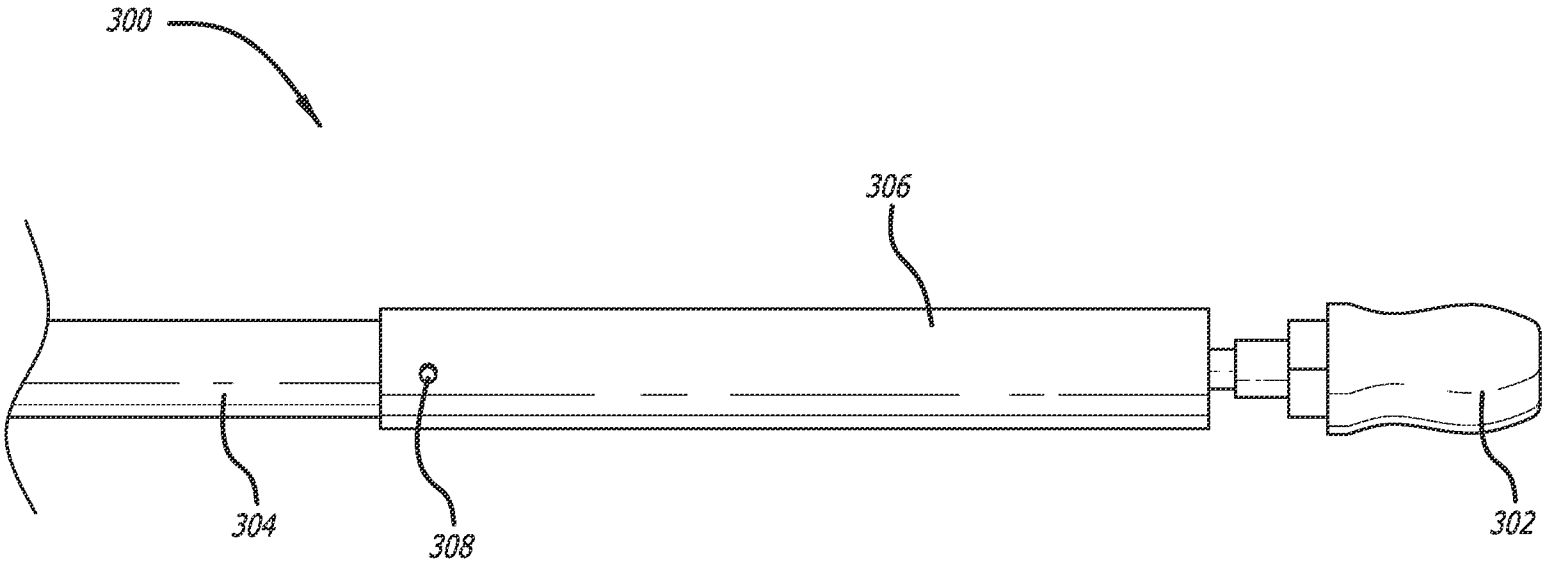
FIG. 3 is an illustration of a wear sleeve and a delivery nozzle of a non-conductive hydro-excavation wand in accordance with an embodiment of the invention.
Figure 4:
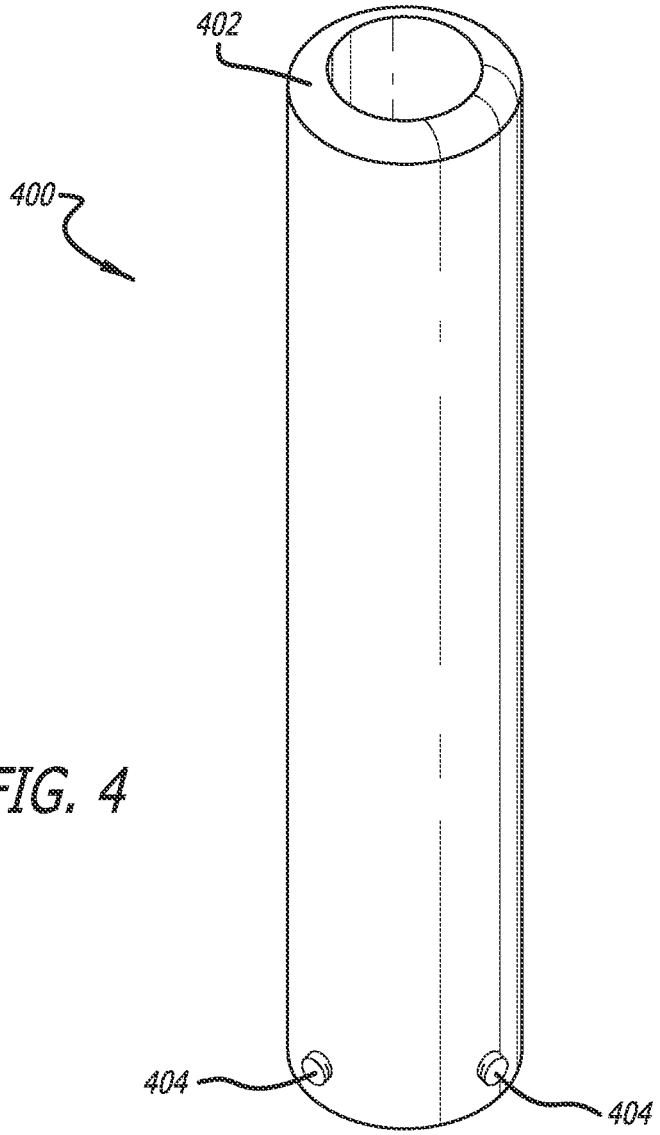
FIG. 4 is an illustration of a wear sleeve in accordance with an embodiment of the invention.

A non-conductive hydro-excavation wand wear sleeve and nozzle in accordance with an embodiment of the invention is illustrated in FIG. 3. The non-conductive hydro-excavation wand delivery nozzle 300 contains a wear sleeve surrounding a non-conductive pipe and a rigid and non-conductive tip 302 that allows for direct delivery of high-pressure water and/or air to the soil for excavation. The non-conductive tip 302 may be composed of, but is not limited to, ceramics, fiberglass, or any other rigid plastic that is non-conductive. The size and shape of the delivery nozzle may vary to allow changes in flow rate or pressure depending on the specific application. In the illustrated embodiment, the wear sleeve includes two segments 304, 306 that are connected via screws 308. The first segment 304 is surrounds the portion of the non-conductive pipe that is further from the non-conductive tip 302. The second segment 306 surrounds the portion of the non-conductive pipe that connects to the non-conductive tip 302. The first segment is relatively thinner (i.e. has a smaller outer diameter) than the second segment. In this way, the second segment provides increased protection to the portion of the non-conductive pipe that is likely to experience the greatest abrasion and/or other forces during use. A segment of the wear sleeve that can be utilized as the second segment of the wear sleeve shown in FIG. 3 is illustrated in FIG. 4. In the illustrated embodiment, the segment of the wear sleeve 400 is cylindrical and includes an opening created by the wall 402 of the wear sleeve and through which a non-conductive pipe can be inserted. The segment of the wear sleeve 400 also includes threaded screws which 404, which can be used to attach the segment of the wear sleeve to another segment.

As noted above, the segment of the wear sleeve protects the rigid non-conductive pipe that delivers high pressure fluid and/or air to the non-conductive tip of the non-conductive hydro-excavation wand from abrasion and/or other forces experienced when the wand is used in confined spaces. In the illustrated embodiment, the wall 402 of the segment of the wear sleeve 400 is constructed from ¼ inch of acetyl plastic. As can readily be appreciated, the thickness and/or material utilized in the construction of any segment of a wear sleeve utilized in accordance with an embodiment of the invention is largely dependent upon the requirements of a specific application.

While a variety of non-conductive hydro-excavation wand wear sleeves and delivery nozzles are described above with reference to FIGS. 3 and 4, the specific components utilized within a non-conductive hydro-excavation wand nozzle and the manner in which materials are chosen are largely dependent upon the requirements of specific applications.

Although the present invention has been described in certain specific aspects, many additional modifications and variations would be apparent to those skilled in the art. It is therefore to be understood that the present invention may be practiced otherwise than specifically described, including various changes in the implementation, without departing from the scope and spirit of the present invention. Thus, embodiments of the present invention should be considered in all respects as illustrative and not restrictive.

What is claimed is:

1. A non-conductive hydro-excavation wand comprising:
- a non-conductive pipe;
- a non-conductive high-pressure hose within the non-conductive pipe;
- a hand-actuated valve connected to the non-conductive high-pressure hose;
- a rigid, non-conductive tip at one end of the non-conductive pipe, the tip having an opening that is open to the interior of the non-conductive high-pressure hose; and
- a wear sleeve of non-conductive material surrounding at least part of the non-conductive pipe;

wherein:
- the wear sleeve comprises two segments, a first segment surrounding a portion of the non-conductive pipe and a second segment surrounding a portion of the non-conductive pipe connected to the non-conductive tip; and
- the second segment is connected to the non-conductive tip and located between the first segment and the non-conductive tip.

2. The non-conductive hydro-excavation wand of claim 1, where the first segment is relatively thinner than the second segment.

3. The non-conductive hydro-excavation wand of claim 1, wherein an attachment mechanism is located at an interface of the first segment to the second segment.

4. The non-conductive hydro-excavation wand of claim 2, wherein the attachment mechanism comprises a plurality of screws.

5. The non-conductive hydro-excavation wand of claim 1, wherein the hand-actuated valve is located at the opposite end of the non-conductive pipe from the non-conductive tip.

6. The non-conductive hydro-excavation wand of claim 1, wherein the wear sleeve is composed of acetyl plastic material.

7. The non-conductive hydro-excavation wand of claim 1, where the non-conductive high-pressure hose has a diameter that is between ¼ of an inch and ¾ of an inch.

8. The non-conductive hydro-excavation wand of claim 1, where the non-conductive pipe has a diameter that is between ½ an inch and 1½ inches.

9. The non-conductive hydro-excavation wand of claim 1, where the second segment of the wear sleeve has a wall thickness of ¼ of an inch.

10. The non-conductive hydro-excavation wand of claim 1, further comprising a high-pressure release valve connected to the hand-actuated valve, where the high-pressure release valve is configured for detachable connection of a second external non-conductive high-pressure hose.

11. The non-conductive hydro-excavation wand of claim 1, further comprising a high-pressure coupler that couples the hand-actuated valve with the non-conductive pipe.

12. The non-conductive hydro-excavation wand of claim 1, wherein the non-conductive tip is a water delivery nozzle that allows for delivery of high-pressure water through at least one opening in the non-conductive tip.

13. The non-conductive hydro-excavation wand of claim 1, wherein the non-conductive pipe is composed of material selected from the group consisting of: fiberglass, ceramic, and Kevlar.

14. The non-conductive hydro-excavation wand of claim 1, wherein the non-conducive tip is composed of material selected from the group consisting of: fiberglass, ceramic, and plastic.

15. A non-conductive hydro-excavation wand comprising:

a non-conductive pipe;

a non-conductive high-pressure hose within the non-conductive pipe;

non-conductive void filler material filling voids between the non-conductive high-pressure hose and the non-conductive pipe;

a rigid, non-conductive tip at one end of the non-conductive pipe, the tip having an opening that is open to the interior of the non-conductive high-pressure hose;

a hand-actuated valve connected to the non-conductive high-pressure hose and located at the opposite end of the non-conductive pipe from the non-conductive tip;

a high-pressure release valve connected to the hand-actuated valve, where the high-pressure release valve is configured for detachable connection of a second external non-conductive high-pressure hose; and a wear sleeve of non-conductive material surrounding at least part of the non-conductive pipe, wherein:

the wear sleeve comprises two segments, a first segment surrounding a portion of the non-conductive pipe and a second segment surrounding a portion of the non-conductive pipe connected to the non-conductive tip;

the second segment is connected to the non-conductive tip and located between the first segment and the non-conductive tip;

the first segment is relatively thinner than the second segment; and an attachment mechanism is located at an interface of the first segment to the second segment.

16. A non-conductive hydro-excavation wand comprising:

a non-conductive pipe having a diameter that is between ½ an inch and 1½ inches and being composed of material selected from the group consisting of: fiberglass, ceramic, and Kevlar;

a non-conductive high-pressure hose within the non-conductive pipe, where the non-conductive high-pressure hose has a diameter that is between ¼ of an inch and ¾ of an inch;

non-conductive void filler material filling voids between the non-conductive high-pressure hose and the non-conductive pipe;

a rigid, non-conductive tip at one end of the non-conductive pipe, the tip having an opening that is open to the interior of the non-conductive high-pressure hose and being composed of material selected from the group consisting of: fiberglass, ceramic, and plastic;

a hand-actuated valve connected to the non-conductive high-pressure hose and located at the opposite end of the non-conductive pipe from the non-conductive tip;

a high-pressure release valve connected to the hand-actuated valve, where the high-pressure release valve is configured for detachable connection of a second external non-conductive high-pressure hose; and a wear sleeve composed of acetyl plastic material surrounding at least part of the non-conductive pipe, wherein:

the wear sleeve comprises two segments, a first segment surrounding a portion of the non-conductive pipe and a second segment surrounding a portion of the non-conductive pipe connected to the non-conductive tip;

the second segment is connected to the non-conductive tip and located between the first segment and the non-conductive tip;

the first segment is relatively thinner than the second segment;

an attachment mechanism is located at an interface of the first segment to the second segment; and the second segment has a wall thickness of ¼ of an inch.

17. A non-conductive hydro-excavation wand comprising:

a non-conductive pipe;

a non-conductive high-pressure hose within the non-conductive pipe;

non-conductive void filler material filling voids between the non-conductive high-pressure hose and the non-conductive pipe;

a hand-actuated valve connected to the non-conductive high-pressure hose;

a rigid, non-conductive tip at one end of the non-conductive pipe, the tip having an opening that is open to the interior of the non-conductive high-pressure hose; and a wear sleeve of non-conductive material surrounding at least part of the non-conductive pipe.

* * * * *